US008408104B2

(12) United States Patent
Lin

(10) Patent No.: US 8,408,104 B2
(45) Date of Patent: Apr. 2, 2013

(54) SCREWDRIVER FOR EXERTING AN ADJUSTABLE MAXIMUM VALUE OF TORQUE

(75) Inventor: Jack Lin, Taichung (TW)

(73) Assignee: Yih Cheng Factory Co., Ltd., Taichung (TW)

( * ) Notice: Subject to any disclaimer, the term of this patent is extended or adjusted under 35 U.S.C. 154(b) by 239 days.

(21) Appl. No.: 12/938,836

(22) Filed: Nov. 3, 2010

(65) Prior Publication Data

US 2012/0103148 A1 May 3, 2012

(51) Int. Cl.
*B25B 23/143* (2006.01)
*B25B 23/157* (2006.01)

(52) U.S. Cl. ..... 81/475; 81/467

(58) Field of Classification Search ..... 81/474, 81/475, DIG. 5
See application file for complete search history.

(56) References Cited

U.S. PATENT DOCUMENTS

| | | | | |
|---|---|---|---|---|
| 4,063,474 | A * | 12/1977 | Klopping | 81/474 |
| 6,095,020 | A * | 8/2000 | Rinner | 81/475 |
| 6,640,674 | B1 * | 11/2003 | Rinner et al. | 81/475 |
| 7,080,581 | B2 * | 7/2006 | Reese | 81/475 |
| 7,197,968 | B2 * | 4/2007 | Bubel | 81/475 |
| 7,222,559 | B2 * | 5/2007 | Wang | 81/467 |
| 7,272,998 | B1 * | 9/2007 | Gauthier | 81/473 |
| 7,334,509 | B1 * | 2/2008 | Gao et al. | 81/475 |
| 7,484,442 | B1 * | 2/2009 | Chen | 81/475 |
| 7,487,700 | B2 * | 2/2009 | Cutler et al. | 81/475 |
| 7,762,164 | B2 * | 7/2010 | Nino et al. | 81/475 |
| 7,793,573 | B2 * | 9/2010 | Gao | 81/475 |
| 7,810,416 | B2 * | 10/2010 | Cutler et al. | 81/467 |
| 7,938,046 | B2 * | 5/2011 | Nino et al. | 81/475 |
| 8,051,751 | B2 * | 11/2011 | Huang | 81/475 |
| 2011/0179917 | A1 * | 7/2011 | Lai | 81/475 |

* cited by examiner

*Primary Examiner* — David B Thomas

(57) ABSTRACT

A screwdriver includes a handle, a shaft, a torque-transmitting unit and a torque-adjusting unit. The shaft is partially inserted in the handle. The torque-transmitting unit is located in the handle and operable to transmit an adjustable maximum value of torque to the shaft from the handle. The torque-adjusting unit is partially located in the handle, connected to the torque-transmitting unit, and operable to adjust the adjustable maximum value of torque.

16 Claims, 4 Drawing Sheets

SCREWDRIVER FOR EXERTING AN ADJUSTABLE MAXIMUM VALUE OF TORQUE

BACKGROUND OF INVENTION

1. Field of Invention

The present invention relates to a screwdriver and, more particularly, to a screwdriver for exerting an adjustable maximum value of torque.

2. Related Prior Art

As disclosed in Taiwanese Patent Publication No. 335757, a conventional screwdriver for exerting an adjustable maximum value of torque includes a handle 10, a driver 20, a follower 30, a shaft 40, a spring 50, a restraining ring 60, an adjusting element 70 and a sleeve 80. The driver 20 is non-rotationally located in the handle 10 while the follower 30 is rotationally located in the handle 10. The follower 30 includes teeth 31 for engagement with teeth 21 of the driver 20. The shaft 40 is inserted through the handle 10, the driver 20, the follower 30, the shaft 40, the spring 50, the restraining ring 60 and the adjusting element 70. The shaft 40 can be rotated relative to the driver 20 but cannot be rotated relative to the follower 30. A bit can be connected to a free end of the shaft 40 which extends from the handle 10. The spring 50 is compressed between the follower 30 and the ring 60. The ring 60 is located against the adjusting element 70 which includes a thread engaged with a thread of the handle 10. By spinning the adjusting element 70 relative to the handle 10, the stress loaded in the spring 50 is adjusted, and so is the extent to which the follower 30 is engaged with the driver 20, and so is the maximum value of torque that can be transferred to the follower 30 from the driver 20. The sleeve 80 is located around the handle 10 and the adjusting element 70.

There are problems encountered during the use of the conventional screwdriver. At first, the cost is high because of the use of the sleeve 80 around the handle 10 and the adjusting element 70 to avoid unintentional spinning of the handle 10 relative to the adjusting element 70.

Secondly, the adjustment of the maximum value of torque is inconvenient because the sleeve 80 must be detached from the handle 10 to allow the spinning of the handle 10 relative to the adjusting element 70 and then connected to the handle 10 to avoid unintentional spinning of the handle 10 relative to the adjusting element 70.

Thirdly, there is no means for compensating decrease of the elasticity of the spring 50 that would otherwise affect the precision of the indication of the maximum value of torque.

The present invention is therefore intended to obviate or at least alleviate the problems encountered in prior art.

SUMMARY OF INVENTION

It is an objective of the present invention to provide an inexpensive screwdriver for exerting an adjustable maximum value of torque.

It is another objective of the present invention to provide a convenient screwdriver for exerting an adjustable maximum value of torque.

To achieve the foregoing objectives, the screwdriver includes a handle, a shaft, a torque-transmitting unit and a torque-adjusting unit. The shaft is partially inserted in the handle. The torque-transmitting unit is located in the handle and operable to transmit an adjustable maximum value of torque to the shaft from the handle. The torque-adjusting unit is partially located in the handle, connected to the torque-transmitting unit, and operable to adjust the adjustable maximum value of torque.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
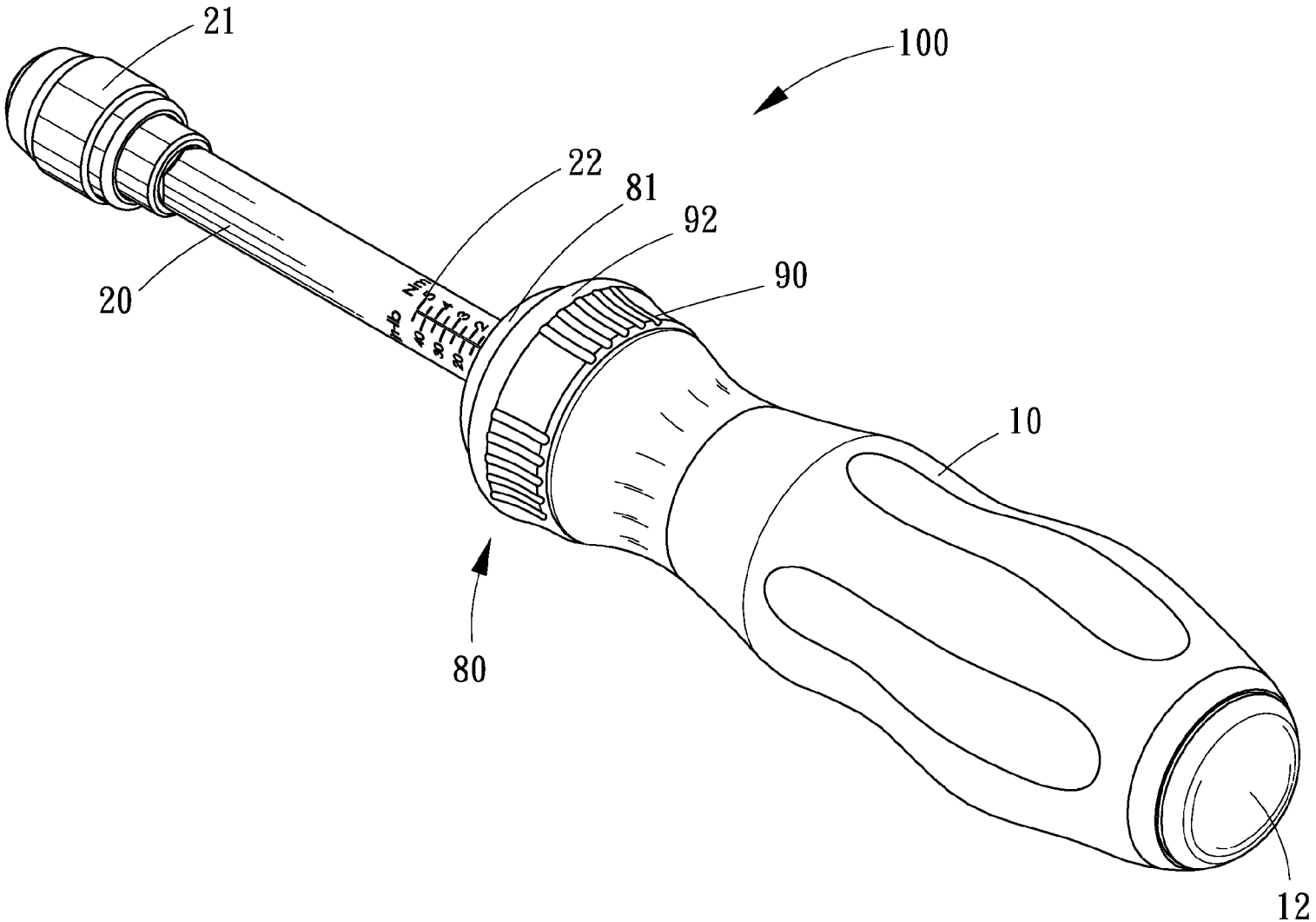
FIG. 1 is a perspective view of a screwdriver for exerting an adjustable maximum value of torque according to the preferred embodiment of the present invention.
Figure 2:
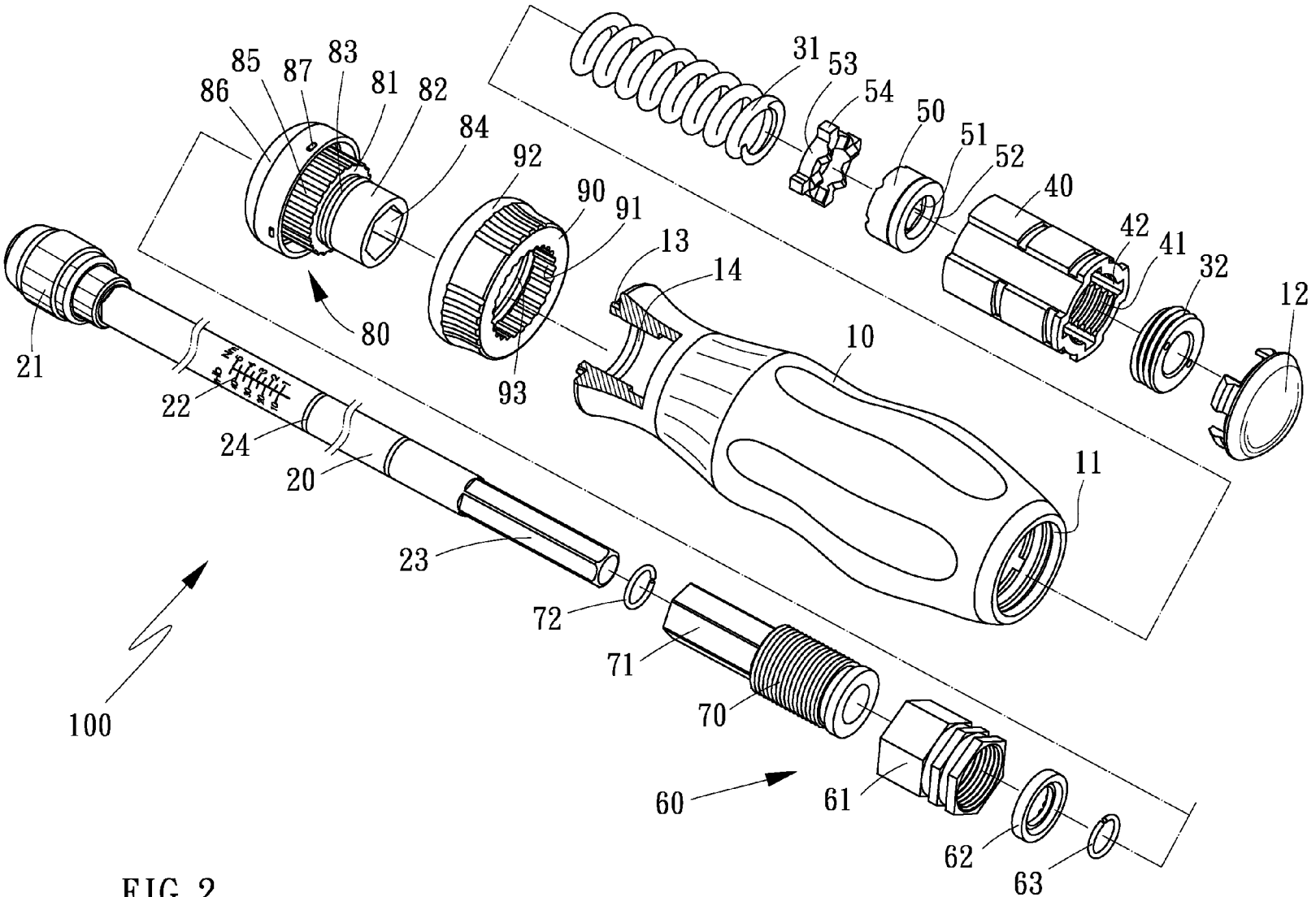
FIG. 2 is an exploded view of the screwdriver shown in FIG. 1.

Referring to FIGS. 1 and 2, a screwdriver 100 includes a handle 10, a shaft 20, a torque-transmitting unit, a torque-adjusting unit and a correcting unit according to the preferred embodiment of the present invention. The torque-transmitting unit includes a driver 53, a follower 50, a bearing 52 and a spring 31. The torque-adjusting unit includes a nut 60, a bearing 62, a screw 70, a knob 80 and a lock 90. The correcting unit includes a nut 40 and a screw 32.

The handle 10 includes front and rear open ends 11. Ribs 13 are formed on an external face of the handle 10 near the front open end 11. An annular groove 14 is defined in an internal face of the handle 10 near the front open end 11. A cap 12 includes hooks that can be fit in an annular groove defined in the internal face of the handle 10 near the rear open end 11.

The shaft 20 front and rear polygonal ends 23, a scale 22 formed thereon, and two annular grooves 24 defined therein. The front polygonal end 23 of the shaft 20 is inserted in a polygonal recess defined in a chuck 21 so that the shaft 20 and the chuck 21 can be spun together.

The driver 53 is substantially in the form of a ring. The driver 53 includes a circular aperture defined therein, blocks 54 formed on an external face, and teeth formed at a rear end.

The follower 50 is also substantially in the form of a ring. The follower 50 includes a polygonal aperture defined therein and cutouts defined in a front end corresponding to the teeth of the driver 53.

The nut 60 includes a thread formed on an internal face. The nut 60 further includes alternately arranged polygonal sections 61 and reduced circular sections 64.

The screw 70 includes a thread formed thereon. The screw 70 further includes a polygonal section 71 formed thereon.

The knob 80 includes a central section 81 extending between a reduced end 82 and an enlarged end 86. Ribs 85 are formed on the central section 81 of the knob 80. The reduced end 82 of the knob 80 includes an annular rib 83 formed on a circular external face. The enlarged end 86 of the knob 80 is substantially in the form of a cap with bosses 87 formed thereon. A polygonal tunnel 84 is defined in the knob 80.

The lock 90 includes grooves 91 defined in an internal face near a rear end, two annular grooves 93 defined in the internal face near a front end, and an annular lip 92 formed at the front end.

The nut 40 includes alternately arranged large and small sections. The nut 40 further includes ribs formed on an external face, a thread 41 formed on an internal face, and grooves 42 defined in the internal face corresponding to the ribs.

Figure 3:
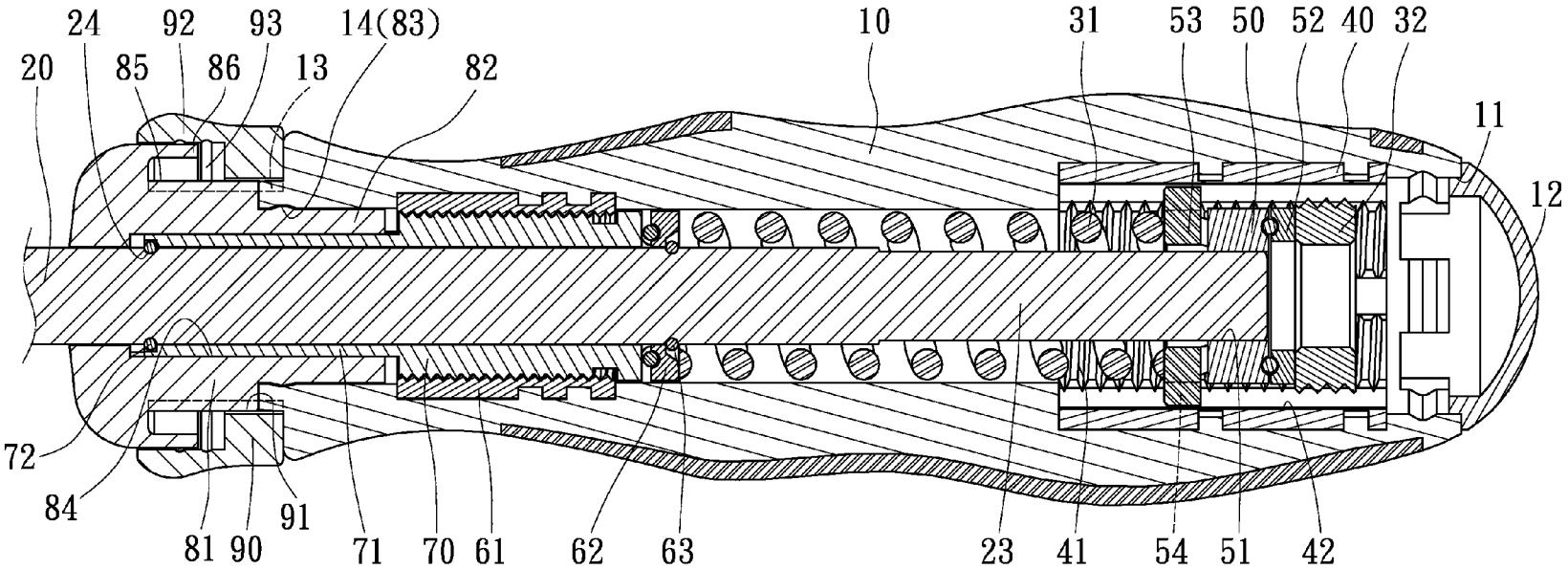
FIG. 3 is a cross-sectional view of the screwdriver shown in FIG. 1.
Figure 4:
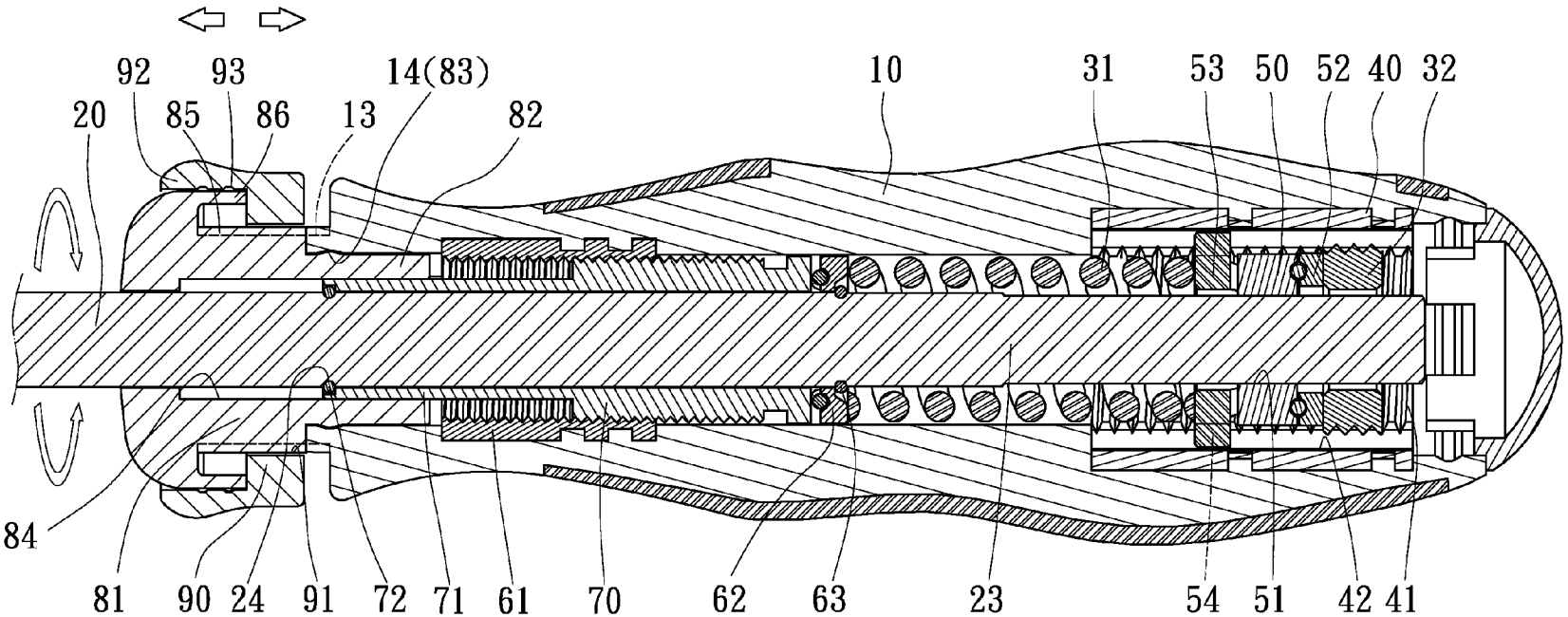
FIG. 4 is a cross-sectional view of the screwdriver in another position than shown in FIG. 3.

Referring to FIGS. 3 and 4, in assembly, the spring 31 is located in the handle 10. The nut 40 is non-rotationally and non-movably located in the handle 10, near the rear open end 11. The nut 40 is non-rotationally located in the handle 10 because of the ribs. The nut 40 is non-movably located in the handle 10 due to the alternately arranged large and small sections. The driver 53 is non-rotationally but movably located in the nut 40, with the blocks 54 movably located in the grooves 42. The driver 53 is located against the spring 31. The follower 50 is rotationally located in the nut 40. The teeth of the driver 53 are located in the cutouts of the follower 50 in a releasable manner. The bearing 52 is located in the handle 10, against the follower 50. The thread of the screw 32 is engaged with the thread 41 of the nut 40. The hooks of the cap 12 are fit in the annular groove defined in the internal face of the handle 10 near the rear open end 11.

The shaft 20 is inserted through the spring 31, the driver 53 and the follower 50. The rear polygonal end 23 of the shaft 20 is inserted through the polygonal aperture 51 defined in the follower 50 so that the shaft 20 can be rotated together with the follower 50.

The nut 60 is engaged with the screw 70. Before the insertion of the shaft 20 through the spring 31, the driver 53 and the follower 50, i.e., into the handle 10, the shaft 20 is inserted through the screw 70, the nut 60 and the bearing 62. A C-clip 72 is located in one of the annular grooves 24 while another C-clip 63 is located in the other annular groove 24. Thus, the screw 70, the nut 60 and the bearing 62 are not movable relative to the shaft 20.

The bearing 62 is located against the spring 31. Thus, the spring 31 is compressed between the bearing 62 and the driver 53. The nut 60 is non-rotationally located in the handle 10 because of the polygonal sections and non-movably located in the handle 10 because of the alternately arranged polygonal sections and reduced circular sections.

The lock 90 is movably located on the knob 80, with the grooves 91 receiving the ribs 85. The annular rib 83 is located in the annular groove 14. The reduced end 82 of the knob 80 is rotationally located in the handle 10, near the front open end 11. The shaft 20 is inserted through the knob 80. The bosses 87 are located in one of the annular grooves 93, thus retaining the knob 80 connected to the handle 10.

In operation, by spinning the handle 10, the nut 40 is spun, and so is the driver 53. Biased by the spring 31, the driver 53 is in engagement with the follower 50 so that the follower 50 is spun. The shaft 20 is pun, and so is the chuck 21. The operation goes on until the driver 53 rattles on the follower 50, i.e., the maximum value of torque is reached.

Referring to FIG. 3, the lock 90 is located in a locking position where the grooves 91 receive the ribs 13 and the ribs 85 while one of the annular grooves 93 receives the bosses 87. Thus, the knob 80 cannot be spun relative to the handle 10. The screw 70 cannot be spun and moved relative to the nut 60. The bearing 62 cannot be moved. Hence, the stress in the spring 31 cannot be changed. That is, the maximum value of torque that can be exerted by the screwdriver 100 is retained.

Referring to FIG. 4, the lock 90 is located in a releasing position where the grooves 91 receive only the ribs 85 while the other annular groove 93 receives the bosses 87. Thus, the knob 80 can be spun relative to the handle 10. The screw 70 can be spun and moved relative to the nut 60. The bearing 62 can be moved. Hence, the stress in the spring 31 can be changed. That is, the maximum value of torque that can be exerted by the screwdriver 100 can be changed.

The coefficient of elasticity of the spring 31 decreases after some time of use. For compensation, the cap 12 is removed from the handle 10, and the screw 32 is spun and moved relative to the nut 40. The bearing 52 is moved. The follower 50 is moved. The driver 53 is moved toward the spring 31 so that the spring 31 is further compressed.

The screwdriver 100 exhibits several advantages over the conventional screwdriver addressed in the Related Prior Art. At first, the screwdriver 100 is inexpensive for not including a sleeve around the handle 10. Secondly, the maximum value of torque can be retained unless otherwise wished. Thirdly, the maximum value of torque can easily be changed by spinning the knob 80 after locating the lock 90 in the releasing position. Fourthly, the decrease of the coefficient of elasticity of the spring 31 can easily be compensated by spinning the screw 32 after detaching the cap 12 from the handle 10.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A screwdriver including:

a handle;

a shaft partially inserted in the handle;

a torque-transmitting unit arranged between the handle and the shaft and operable to transmit an adjustable maximum value of torque to the shaft from the handle, wherein the torque-transmitting unit includes:

a driver placed movably but non-rotationally in the handle, wherein the shaft is inserted rotationally through the driver;

a follower placed rotationally in the handle, wherein the shaft is inserted non-rotationally through the follower; and a spring; and a torque-adjusting unit partially located in the handle, connected to the torque-transmitting unit, and operable to adjust the adjustable maximum value of torque, wherein the torque-adjusting unit includes:

a screw placed rotationally and movably in the handle, wherein the spring is compressed between the screw and the driver to bring the driver into releasable engagement with the follower, wherein the shaft is rotationally inserted through the screw; and a nut placed non-rotationally and non-movably in the handle and engaged with the screw.

2. The screwdriver according to claim 1, wherein the torque-adjusting unit includes a knob connected to the screw so that the knob is operable to spin the screw.

3. The screwdriver according to claim 2, wherein the torque-adjusting unit includes a lock movable between a locking position to avoid spinning of the knob relative to the handle and a releasing position to allow spinning of the knob relative to the handle.

4. The screwdriver according to claim 3, wherein the handle includes ribs formed thereon, wherein the knob includes ribs formed thereon, wherein the lock includes grooves for receiving the ribs of the handle and the ribs of the knob in the locking position and receiving only the ribs of the knob in the releasing position.

5. The screwdriver according to claim 4, wherein the knob includes bosses formed thereon, wherein the lock includes two annular grooves, wherein the bosses of the knob are located in one of the annular grooves of the lock in the locking position, wherein the bosses of the knob are located in the other annular groove of the lock in the releasing position.

6. The screwdriver according to claim 1, wherein the shaft is formed with a scale readable to indicate the adjustable maximum value of torque.

7. The screwdriver according to claim 6 including a correcting unit partially located in the handle opposite to the torque-adjusting unit, connected to the torque-transmitting unit, and operable to correct errors in the indication of the adjustable maximum value of torque by the scale.

8. The screwdriver according to claim 7, wherein the torque-transmitting unit includes:

a driver movably but non-rotationally located in the handle, wherein the shaft is rotationally inserted through the driver;

a follower rotationally located in the handle against the correcting unit, wherein the shaft is non-rotationally inserted through the follower; and a spring compressed between the driver and the torque-adjusting unit to bring the driver into releasable engagement with the follower.

9. The screwdriver according to claim 8, wherein the correcting unit includes a screw located in the handle rotationally and movably and located against the follower, wherein the shaft is rotationally inserted through the screw.

10. The screwdriver according to claim 9, wherein the correcting unit includes a nut located in the handle non-rotationally and non-movably and engaged with the screw.

11. The screwdriver according to claim 10 including a cap for attachment to the handle to cover the screw.

12. A screwdriver including:

a handle;

a shaft partially inserted in the handle and formed with a scale readable to indicate the adjustable maximum value of torque;

a torque-transmitting unit arranged between the handle and the shaft and operable to transmit an adjustable maximum value of torque to the shaft from the handle; and a torque-adjusting unit partially located in the handle, connected to the torque-transmitting unit, and operable to adjust the adjustable maximum value of torque; and a correcting unit partially located in the handle opposite to the torque-adjusting unit, connected to the torque-transmitting unit, and operable to correct errors in the indication of the adjustable maximum value of torque by the scale.

13. The screwdriver according to claim 12, wherein the torque-transmitting unit includes:

a driver movably but non-rotationally located in the handle, wherein the shaft is rotationally inserted through the driver;

a follower rotationally located in the handle against the correcting unit, wherein the shaft is non-rotationally inserted through the follower; and a spring compressed between the driver and the torque-adjusting unit to bring the driver into releasable engagement with the follower.

14. The screwdriver according to claim 13, wherein the correcting unit includes a screw located in the handle rotationally and movably and located against the follower, wherein the shaft is rotationally inserted through the screw.

15. The screwdriver according to claim 14, wherein the correcting unit includes a nut located in the handle non-rotationally and non-movably and engaged with the screw.

16. The screwdriver according to claim 15 including a cap for attachment to the handle to cover the screw.

* * * * *